US011631393B1

(12) United States Patent
Pelzer et al.

(10) Patent No.: US 11,631,393 B1
(45) Date of Patent: Apr. 18, 2023

(54) RAY TRACING FOR SHARED REVERBERATION

(71) Applicant: Apple Inc., Cupertino, CA (US)

(72) Inventors: Soenke Pelzer, Los Gatos, CA (US); David E. Romblom, Palo Alto, CA (US); Dirk Schroeder, San Jose, CA (US); Jonathan D. Sheaffer, San Jose, CA (US)

(73) Assignee: Apple Inc., Cupertino, CA (US)

( * ) Notice: Subject to any disclaimer, the term of this patent is extended or adjusted under 35 U.S.C. 154(b) by 43 days.

(21) Appl. No.: 17/469,255

(22) Filed: Sep. 8, 2021

Related U.S. Application Data

(60) Provisional application No. 63/078,735, filed on Sep. 15, 2020.

(51) Int. Cl.
*G10K 15/08* (2006.01)

(52) U.S. Cl.
CPC ..... *G10K 15/08* (2013.01)

(58) Field of Classification Search
CPC .. H04S 2420/01; H04S 7/303; H04S 2400/01; H04S 7/305; H04S 7/302; G10K 15/08; G10K 15/02
USPC ..... 381/63, 61; 700/94
See application file for complete search history.

(56) References Cited

U.S. PATENT DOCUMENTS 5,784,467 A * 7/1998 Asayama ..... H04S 3/00 381/63
6,169,806 B1 * 1/2001 Kimura ..... H04S 7/30 381/310

OTHER PUBLICATIONS

Valimaki, Vesa, et al., "More Than Fifty Years of Artificial Reverberation," AES 60th International Conference, Feb. 3-5, 2016, 12 pages.
Elorza, David Oliva, "Room acoustics modeling using the ray-tracing method: implementation and evaluation," Licentiate Thesis, University of Turku, 2005, 116 pages.
Pelzer, Soenke, et al., unpublished U.S. Appl. No. 15/900,874, filed Feb. 21, 2018, 61 pages.
Schroder, Dirk, et al., unpublished U.S. Appl. No. 15/900,862, filed Feb. 21, 2018, 61 pages.

* cited by examiner

*Primary Examiner* — Norman Yu
(74) *Attorney, Agent, or Firm* — Aikin & Gallant, LLP

(57) ABSTRACT

Ray tracing is performed with sound sources and a listener position in a listening environment, to generate impulse responses associated with each of the sound sources. The impulse responses are combined to form a combined impulse response. One or more filters are determined, each corresponding to the sound sources, based on the combined impulse response and the impulse responses. Each filter serves as a correction factor that holds unique acoustic information for the sound source that the filter is associated with. The combined impulse response and the filters can be applied to one or more audio signals that contain the sound sources, resulting in audio having reverberation that is tailored to the various sound sources. Other aspects are described and claimed.

20 Claims, 5 Drawing Sheets

RAY TRACING FOR SHARED REVERBERATION

CROSS-REFERENCE TO RELATED APPLICATION

This application claims the benefit of U.S. Provisional Patent Application No. 63/078,735 filed Sep. 15, 2020, which is incorporated by reference herein in its entirety.

FIELD

One aspect of the disclosure herein relates to generating reverberation using ray tracing.

BACKGROUND

Acoustic energy that travels in listening area, such as a room, can bounce off of surfaces. The reflected acoustic energy can reflect from one surface to another. The acoustic energy dissipates overtime as it travels through the air (or other medium) and becomes absorbed by surfaces. This phenomenon is known as reverberation. Although reverberation occurs naturally in places that hold sound, for example, in a concert hall, reverberation can also be electronically added to audio, such as a musical recording, to add a sense of space to the sound.

Ray tracing is an algorithm that can be performed by a computer to simulate how rays spread in a simulation environment. Tracing of each ray provides information as to how particles or waves will travel in such an environment. Ray tracing can be used for graphical rendering such as for film and videogames, as well as lighting design, engineering, and architecture. Ray tracing can also be used for audio processing.

SUMMARY

In some aspects of the present disclosure, a method for creating reverberation of audio is described. Ray tracing is performed with one or more sound sources and a listener position, to generate one or more impulse responses associated with each of the one or more sound sources. The ray tracing can be performed in a reciprocal manner, e.g., reciprocal ray tracing, where rays are originated from the listener position to each of the one or more sound sources. In such a manner, all sound sources can be traced at once in parallel to determine impulse response of each source, relative to listener position.

The one or more impulse responses can be combined to form a combined impulse response. One or more filters are determined based on the combined impulse response and the individual one or more impulse responses. Each of the filters are associated with a corresponding one of the one or more impulse responses, which, in turn, is associated with a corresponding one of the one or more sound sources. Thus, each of the filters is also associated with the one or more sound sources.

The combined impulse response and the one or more filters can be applied to one or more audio signals to produce audio with reverberation that sounds as if the reverberation has individual reverberation components of each of the one or more sound sources. In such a manner, the method can utilize a single impulse response (e.g., only one) to create a reverberation that is shared between the sound sources. The reverberated audio is corrected by each filter to tailor the reverberation to contain individualized reverberation components. Such an approach can reduce computational overhead—rendering of a single reverberation is less costly than rendering reverberation for each individual sound source. Correction for each sound source using the filters also reduces overhead when compared to rendering individual reverberations. The reverberation data (e.g., the combined impulse response and filters) can be shared across devices with minimal footprint. The method can be performed by an electronic device, an audio processing system, or other computing device having one or more programmed processors.

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the Claims section. Such combinations may have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Several aspects of the disclosure with reference to the appended drawings are now explained. Whenever the shapes, relative positions and other aspects of the parts described are not explicitly defined, the scope of the invention is not limited only to the parts shown, which are meant merely for the purpose of illustration. Also, while numerous details are set forth, it is understood that some aspects of the disclosure may be practiced without these details. In other instances, well-known circuits, structures, and techniques have not been shown in detail so as not to obscure the understanding of this description.

Figure 1:
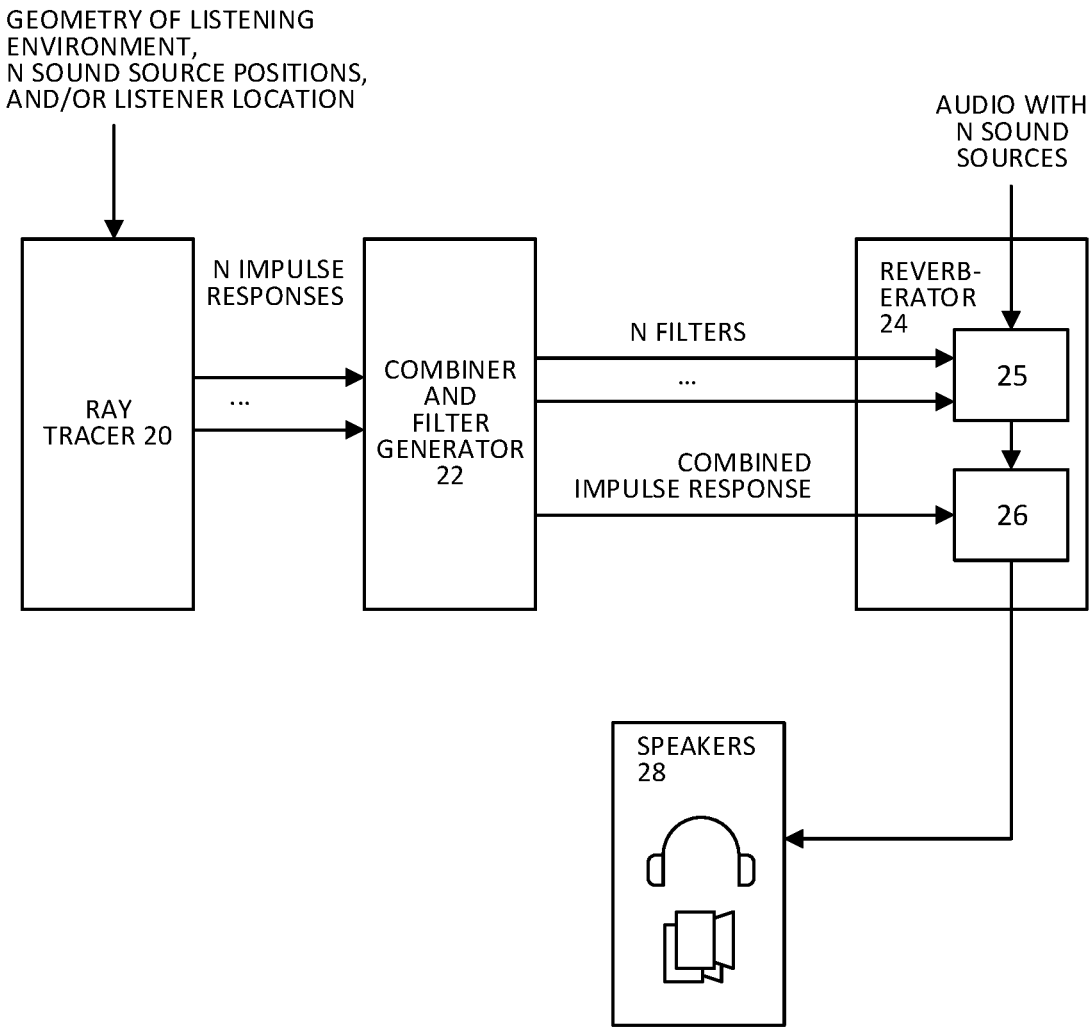
FIG. 1 shows an example of audio processing using ray tracing to produce reverberation, according to some aspects.

FIG. 1 shows an example of audio processing using ray tracing to produce reverberation, according to some aspects. A ray tracer 20 performs ray tracing with one or more sound sources (N sound sources) and respective positions a listener position, to generate one or more impulse responses (N impulse responses). Each impulse response is associated with one of the one or more sound sources and characterizes a delay and energy loss of the acoustic energy along a path. The delay and energy loss can be frequency-dependent.

Ray tracing is a method for calculating the path of acoustic energy or particles through a system with regions of varying propagation velocity, absorption characteristics, and reflecting surfaces. Wave fronts may bend, change direction, or reflect off surfaces, complicating analysis of the wave fronts. Ray tracing solves the problem by repeatedly advancing idealized narrow beams called rays through the medium by discrete amounts. Ray tracing can be performed by using a computer to simulate the propagation of many rays in a simulation environment (e.g., a three-dimensional model of a room or other space).

A combiner and filter generator 22 can combine the one or more impulse responses determined through ray tracing to form a combined impulse response. In some aspects, the combined impulse response can be determined by summing each of the impulse responses. Additionally, or alternatively, the combined impulse response is formed by averaging the one or more impulse responses.

The combiner and filter generator 22 determines one or more filters based on the combined impulse response and the one or more impulse responses that is associated with each of the sound sources. Each corresponding filter corresponds to or is associated with one of the one or more impulse responses, which, in turn, is associated with one of the one or more sound sources. Thus, each filter is also associated with one of the one or more sound sources. Each filter characterizes a difference (e.g., frequency dependent levels and/or a time delay) between the combined impulse response and the impulse response that the filter is associated with. Levels can also be expressed as a gain (e.g., if levels are normalized).

As mentioned, the one or more impulse responses associated with each sound source can be summed together to form the combined impulse response. In some aspects, the combined impulse response can be represented by a histogram that stores time and energy that represents each occurrence where a ray intersects with a receiver. This is described further in other sections.

In some aspects, each of the one or more filters are determined based on difference between the combined impulse response and a corresponding one of the one or more impulse responses. These differences can include frequency-dependent levels, gains, and/or delays. The filter represents a difference between the impulse response of a particular sound source relative to the listener, as compared to an average impulse response of the sound sources relative to the listener. The filters can be understood as offset filters or correction filters that, when applied, can offset or correct the audio relative to the shared impulse response. The combined system of shared impulse response and per-source correction filters may approximate the results of each source having its own individual impulse response. In some aspects, the combined impulse response and individual one or more impulse responses may be computed as energetic impulse responses, which, as described in other sections, can be stored as energy decay histograms. The combined impulse response and individual impulse responses can be determined as energetic impulse responses rather than as pressure impulse responses. In some aspects, a single pressure impulse response (e.g., represented by the one or more filters) can be determined from the combined energetic response.

In some aspects, time and spatial dimensions of the one or more impulse responses are averaged in the combined impulse response, to reduce statistical variance. The remaining frequency data can be used to derive the one or more filters for each of the sound sources. For example, the remaining frequency data of the combined impulse response can be compared to the each of the individual one or more impulse responses to determine the difference.

The filter can vary based on directivity of the sound source. For example, an omni-directional sound source can have a different impulse response than a sound source with a high directionality (e.g., a narrow and/or elongated polar pattern). Accordingly, the filter of the omni-directional sound source can be different from that of the sound source with high directionality.

In some aspects, the one or more filters include frequency-dependent factors such as, for example, energy decay over-time for different frequencies and directions, or the reverberation levels for different frequencies. For example, a bright sound may have higher energy in high frequencies, however, have a shorter reverberation time than lower frequency sounds. Thus, the reverberation contribution from higher frequency sounds can be heard louder but tail off quicker, than sounds with lower frequency. Frequencies can be grouped into frequency bands. Thus, filters can have coefficients for different frequency bands.

In some aspects, each filter can also include or be associated with a time delay. The time delay can be determined through the ray tracing algorithm, based on how long it takes for reverberation of a particular sound source to be perceived by a listener at the listener position. For example, if the listening area is simulated in a long space, and one sound source is close to the listener while another sound source is at a far end of the space, then the reverberation from the far away source will have larger time delay than the closer sound source. The time delay can depend on frequency as well as distance between a sound source and the listener in the simulation.

It should be understood that, in some aspects, the combiner and filter generator and the ray tracer can be integrated. The combined impulse response and/or the generation of the filters can be performed as part of the ray tracing algorithm. For example, the combined impulse response and filters can be determined simultaneously as each impulse response for each sound source is determined when performing the ray tracing algorithm.

A reverberator 24 can generate reverberation that is shared by the one or more sound sources. The reverberator can employ classical reverberation algorithms such as, for example, delay networks, convolution algorithms, computational acoustics, or virtual analog models. The shared reverberation is generated based on the combined impulse response. This reverberation can be an average reverberation or estimated average reverberation based on the conditions of the ray tracing simulation. At block 25, the one or more filters are also applied to the audio signal. For example, each of the individual one or more filters may be applied to each of N sound sources. The N sound sources may be combined to form a single combined audio signal. At block 26, one or more of the reverberation algorithms can be applied to audio (e.g., the combined audio signal) using the combined impulse response to generate the reverberated audio. For example, the combined impulse response can be applied to the audio signal with one or more convolution algorithms to generate the reverberation of the audio signal. The resulting audio has individualized reverberation of each of the one or more sound sources.

By applying a single combined impulse response rather than individual impulse responses to a combined audio signal, the reverberation for audio can be created in an efficient manner, especially where sound sources are plentiful. Further, in some aspects, if the reverberation is shared from one device to another (e.g., transmitted through a channel to a playback or rendering device), this approach reduces the communication overhead.

In some aspects, the reverberator 24 can apply delay networks that simulate reverberation characterized by the combined impulse response by using delay lines, filters, and feedback connections. In some aspects, the reverberator 24 can include a velvet-noise reverberator or a scattering delay network, or other reverberation algorithm to generate to reverberate the audio as specified by the combined impulse response.

It should be understood that the audio signal can have sound sources that correspond to those that were used in the simulation. The format of the audio signal can vary from one application to another. For example, the audio signal can include one or more audio channels such as audio channels used to drive a surround sound speaker system (e.g., 5.1, 7.1, 7.2, etc.). The audio signal can be spatial audio (e.g., binaural audio). In some aspects, the audio can be object-based, where each sound source has a dedicated audio signal and metadata.

The reverberated audio can be used to drive one or more speakers 28. The speakers 28 can include one or more speaker arrays, a plurality of loudspeakers, a headphone set (e.g., in-ear, on-ear, or over-hear speakers), or other playback device having one or more speakers. In some aspects, the audio is additionally processed with other audio processing algorithms, although not shown in FIG. 1 for conciseness. For example, the audio can be spatially rendered with one or more spatial filters and/or up-mixed or down-mixed to fit a particular channel-based format. The audio can be channel-based (e.g., 5.1. 6.1, 7.1, or 7.2), object-based, or scene-based (e.g., Ambisonics). Object-based audio can be rendered to channels, binaural, arrays, or scene-based. In the case of existing channel-based or scene-based content, a reverberator can be used for virtualization.

Figure 2:
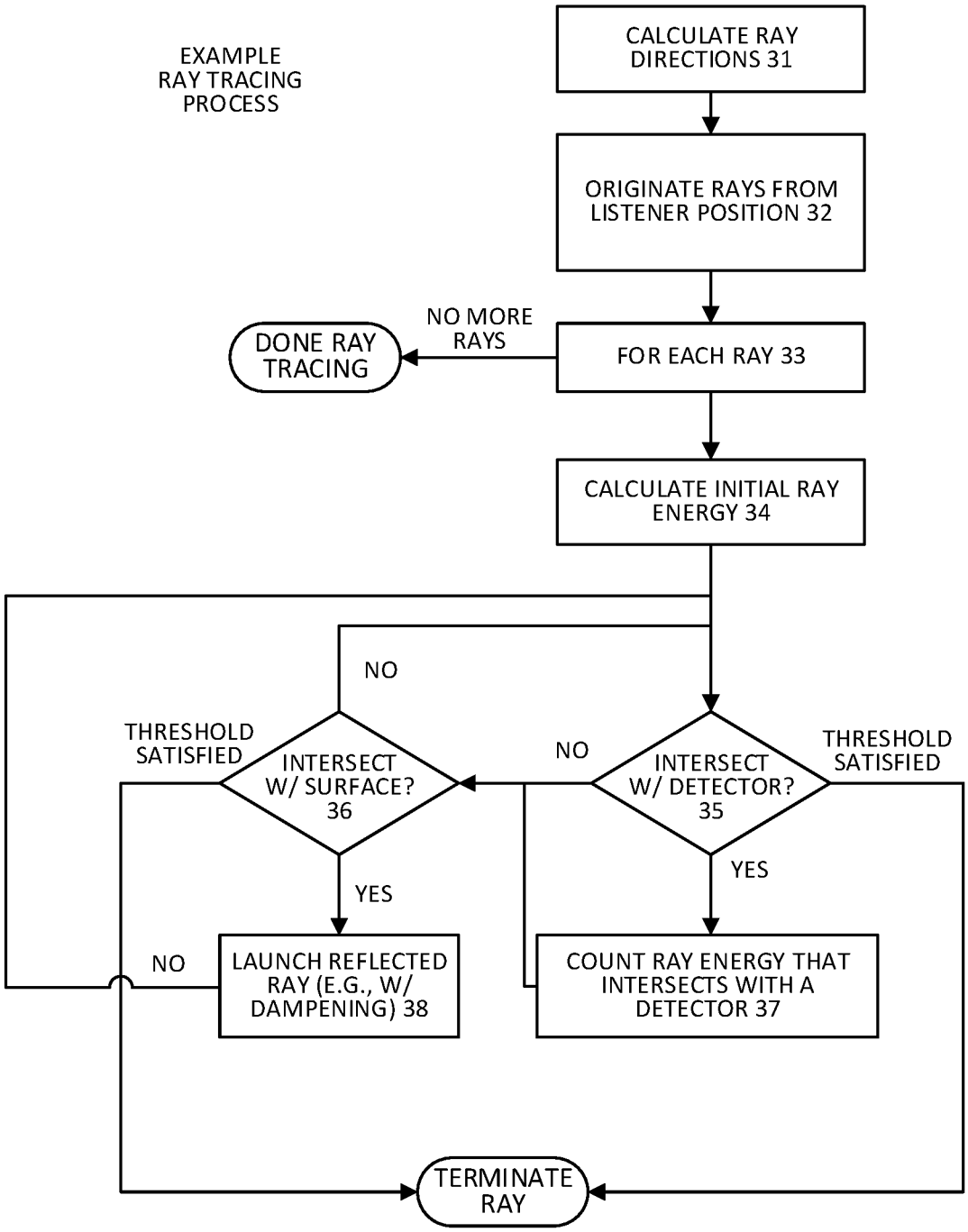
FIG. 2 shows an example ray tracing algorithm, according to some aspects.

FIG. 2 shows an example ray tracing algorithm, according to some aspects, which can be performed by a programmed processor (e.g., a ray tracer such as the one shown in FIG. 1). At block 31, the ray directions are calculated. These directions can be determined, for example, based on the room geometry of the listening area, and/or the positions of the sound sources relative to the listener. In some aspects, the ray directions can be determined as randomly being emitted from the listener location in all directions. In some aspects, they can be launched from the listener location to target certain directions, e.g., by specifying density in different directions. The room geometry can be provided in the form of a three dimensional model of a listening space such as a room, concert hall, auditorium, etc.

Data structures such as, for example, histograms, may track, overtime, both the frequency bands of the received sound energy, as well as the frequency-dependent energy levels of the received sound energy. In some aspects, a Probability Density Function (PDF) may be generated, where from directions of incoming sound waves may be derived based on the amount of energy, regardless of their frequency. A spectral "Energy Decay Curve" (EDC), which may also be represented as "EDC(t, f)" to reflect its dependency on time and frequency data, may then be derived from the frequency-dependent data, regardless of direction, thereby, in combination, fully characterizing the results of the ray tracing simulation in the room model.

In some aspects, for increased accuracy, the ray tracing detectors in the simulated environment may be modeled as having either a volume or a surface, so that it can be determined when (and whether) an incident ray bouncing around a room environment would be "heard" by a given detector "listening" to the room. Different geometry of detectors may be modeled (e.g., spheres, cubes, surfaces, etc.), depending on the needs and/or processing capabilities of a given ray tracing implementation.

Types of general information that may be stored for a particle that is subject to a ray tracing simulation may include, e.g., spectral energy level, starting point, ending point, travel direction, propagation time, last hit surface, etc. Supplemental information on the particle's reflection history may also be stored along with the particle's general information. In this way, each energy particle becomes an independent data entity that carries all required information for handling the respective particle propagation during the simulation, which also includes decisions about whether the particle may be counted by a detector that intersects with the current reflection path.

At block 32, rays are originated from the listener position in the listening area. For each ray, the following operations are performed. The initial ray energy is calculated at block 34. At block 35, when the ray intersects with a detector, which represents one of the sound sources, the process proceeds to block 37 to count the ray energy that intersects with the detector. Position of the listener and each of the detectors can be extracted from metadata relating to an audio recording. Thus, the reverberation for that audio recording can be generated as a result of the ray tracing and other operations described herein.

As mentioned, the ray can be counted with one or more data structures such as histograms. Counting refers to storing information of the ray such as time of intersection, energy, direction, etc. For example, a histogram can keep a time and energy for each ray that intersects with a particular detector. The energy loss of each ray, as well as the number of rays that pass through each detector at different times, and the direction of those rays, represent the impulse response associated with that sound source (which is represented by a detector).

If the ray does not intersect with a detector, then at block 36 the process determines if the ray intersects with a surface, such as a wall, the floor, ceiling, furniture, or other objects in the simulated listening area. If the ray intersects with a surface then, at block 38, a reflected ray is launched. The reflected ray can have a direction that is determined based on the direction of the ray, the shape of the surface, and an angle at which the ray hits the surface. Further, ray energy can dissipate when hitting a surface (e.g., depending on absorption of the surface) and/or as it travels through the simulated medium (e.g., air). If the ray (either direct or reflected) falls below a threshold level of energy or otherwise satisfies some threshold, then the ray can be terminated (at block 35 or at block 36). When all rays are counted and/or terminated, the ray tracing is complete.

In such a manner, by originating rays from the listener, all sound sources can be covered with a single trace of the rays (rather than performing multiple traces for each sound source). Such an approach can be used for situations where there are many sound sources because each additional sound source results in minimal overhead to the ray tracing algorithm—rays are traced for all sound sources in a single trace. Further, as the number of sound sources increases, the total volume (space occupied in the simulation area) of the detectors also increases. This increases likelihood of detecting rays during simulation, which means that the number of rays that are simulated can be reduced. Thus, the number of rays that are originated in a simulation can be decreased as the number of sound sources is increased.

The counter-intuitive phenomenon of higher sound source count and lower ray tracing overhead can result in degraded quality, however, due to fewer rays being detected as they originate from a single source (listener). To compensate for this, the contribution of each detector or sound source can be added together to form a combined impulse response (e.g., represented as a single histogram). Time and spatial dimensions across the impulse responses can be averaged in the combined impulse response. Each filter can be derived for each of the sound sources based on difference between of each individual impulse response (which can each be represented as a separate histogram), and the average combined impulse response. These correction factors can be represented by the filters discussed herein. As a result of the ray tracing simulation, the combined impulse response as well as the filters are determined. Each of the filters can represent a difference between an individual impulse response of a sound source and the combined impulse response, across a frequency spectrum.

In some aspects, to adjust reverberation for a different listener location than the position used in the ray tracing, rather than performing the ray tracing again, a correction can be determined for the new listener location, based on the existing impulse response and filters. For example, if a user is hearing the reverberated audio in a head-tracked application, and the user moves, the audio system can apply a correction to the reverberation. The correction can be extrapolated based on the existing combined impulse response and the filters.

Figure 3:
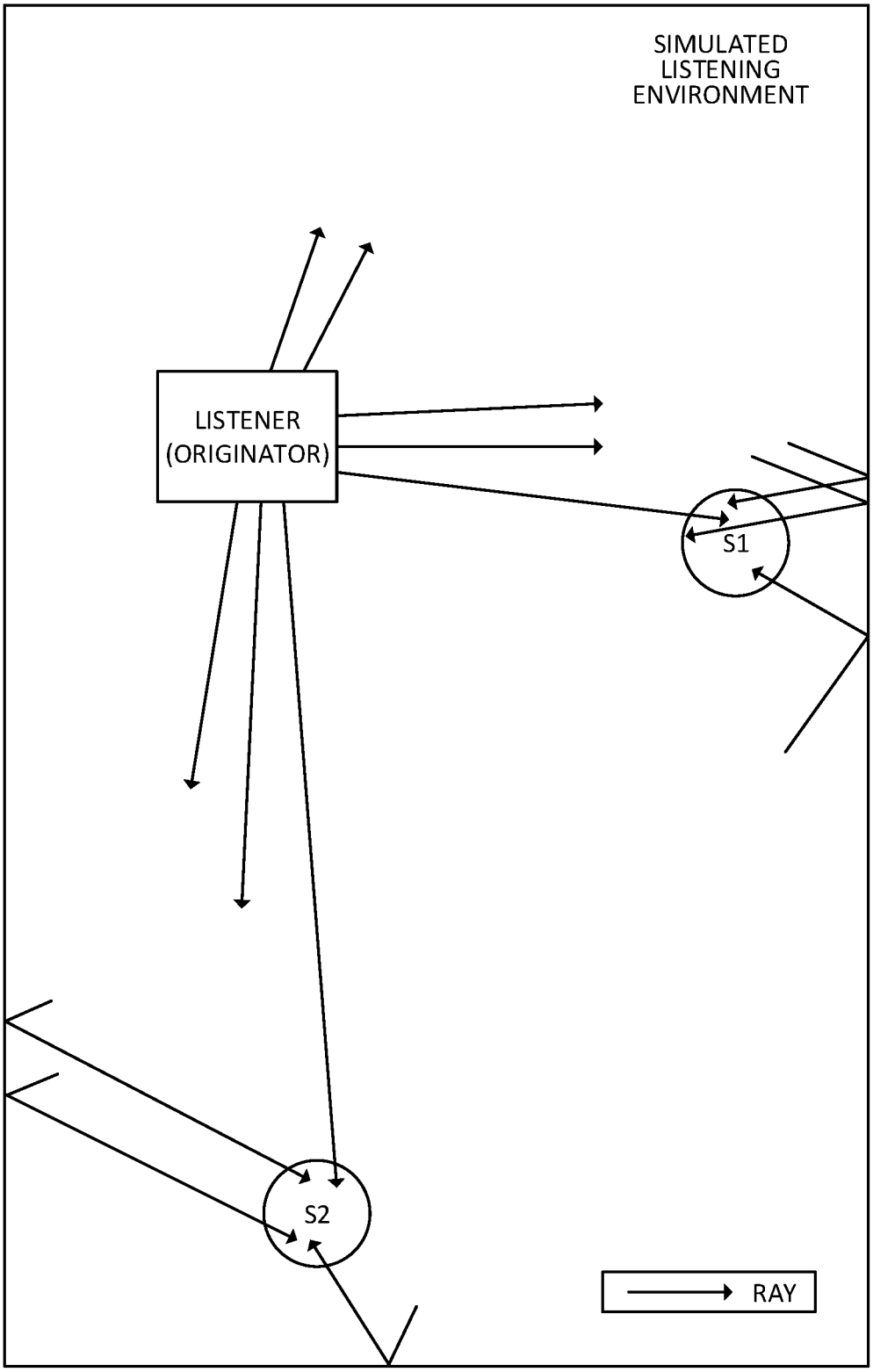
FIG. 3 illustrates an approach of ray tracing, according to some aspects.

FIG. 3 illustrates a simulated ray tracing environment, according to some aspects, such as those described in relation to FIG. 1 and FIG. 2. A listener position is shown in the simulated listening environment, as well as sound sources S1 and S2. The simulated listening environment can be defined as a CAD model that defines geometry of a room (e.g., wall height and lengths). The environment can include furniture and other objects. The model can include damping coefficients of surfaces of the walls, ceiling, floor, and objects, to simulate how different surfaces can absorb sound differently. Each time a ray hits and reflects off a surface, an amount of energy that the reflected ray retains depends on the damping coefficients. The higher the damping coefficient, the less energy is retained. A room with highly dampening surfaces may have a shorter reverberation time than a room with more less dampening surfaces, and vice versa.

Under this approach of FIG. 3, rays are originated from the listener position. Sound sources such as those illustrated by S1 and S2 have the role of sound detectors in the simulation. As mentioned, volume and geometry of each detector can be determined based on application. Raytracing involves simulating the movement and paths of the rays (or particles) as they bounce around in the room, reflect off of surfaces, and losing energy in the process.

When rays intersect (e.g., pass through) a detector, the energy of the ray is counted for that sound source, as described in other sections. The impulse response for each sound source can be determined based on comparing the initial energy of a ray to the received energy of a ray at the sound source, for all the rays that are detected for a particular detector.

As stated, under this approach, a single shared impulse response can be generated for multiple sound sources in a single trace. Filters can carry correction factors for each sound source with respect to the shared impulse response are generated. For example, S1 has an associated filter and S2 has an associated filter. When a reverberator applies the S1 filter and the combined impulse response to audio containing S1, then the reverberation becomes tailored to S1.

Although the role of the sound source as the ray originator and the listener as the ray detector are inverted under this approach, the ray paths that are generated under this approach are equivalent to when the sound source is the ray originator. Thus the results of the ray tracing under this approach are sufficiently representative of how sounds would reverberate in such an environment that is simulated.

In some aspects, this ray tracing approach is applied when there is a plurality of sound sources, e.g., greater than two sound sources, or greater than 10 sound sources, or greater than 20 sound sources. It should be understood that ray tracing can involve hundreds, thousands, or millions of rays, thus a data processing system (e.g., a computer) may be required to perform ray tracing.

Figure 4:
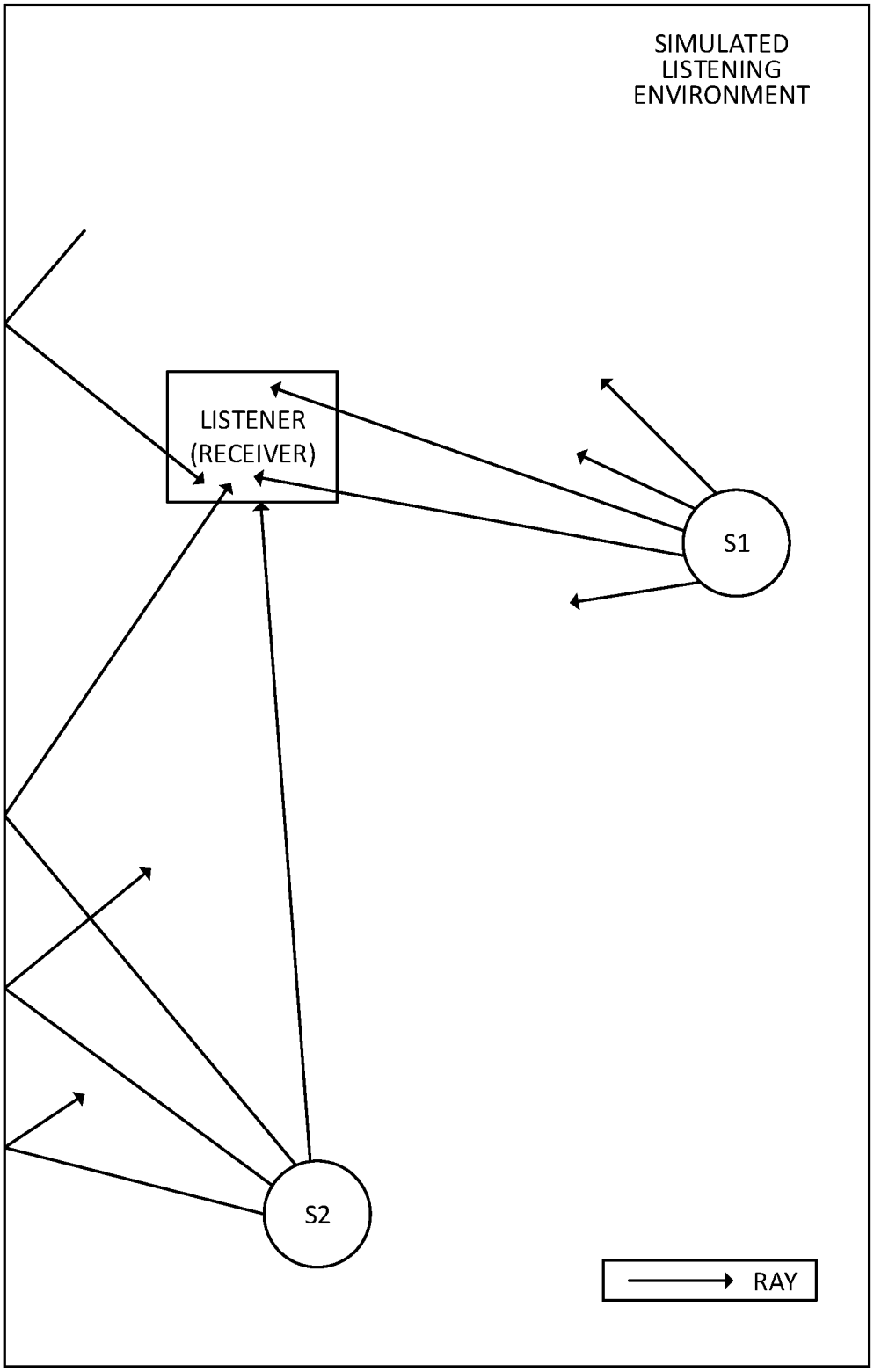
FIG. 4 illustrates another approach of ray tracing.

FIG. 4 illustrates another approach of ray tracing in an audio application. Under this approach, each sound source (e.g., S1 and S2) are originators of rays, and a detector is placed at the listener position. For each sound source, a tracing is performed, which can require substantial computational effort. Thus, this approach may be less suitable for audio applications where multiple or many sound sources are present when compared with the approach of FIG. 3.

Further, under this approach of FIG. 4, each trace results in a different impulse response associated with the originating sound source. If these impulse responses are to be shared from one device to another, then transmission of this reverberation information can become prohibitively costly. With regard to rendering, each of these impulse responses may need to be applied to an audio signal (e.g., convolution) which can further consume processing resources.

Referring back to FIG. 1, ray tracing and determination of the combined impulse response and N filters can be performed or determined offline, for example, during production of an audio recording. The N filters and impulse response can be transmitted to an electronic device (e.g., intermediate or playback device) for audio rendering. For example, the filters and impulse response can be made available on a networked computer. In some aspects, the impulse response and filters can be included in metadata that accompanies an audio asset (e.g., a musical work, a digital audio file, a movie soundtrack, a video, etc.).

The combined impulse response and filters can be transmitted to and received by an electronic device such as a smartphone, a tablet computer, a speaker system with one or more speakers, a headphone set, a desktop or laptop computer, a vehicle head-unit, or other electronic device capable of processing audio. The electronic device can apply the impulse response and the filters to audio (e.g., with reverberator 24), resulting in reverberated audio. The audio can be used to drive speakers 28 which can be integral or external to the electronic device. The impulse response, the filters, and/or the audio signal can be transmitted and received over known wired or wireless communication protocols such as, for example, TCP/IP, Wi-Fi, LTE or variations thereof, 4G, 5G, etc. In some aspects, the impulse response and the filters can be transmitted and received over a dedicated communication channel.

Figure 5:
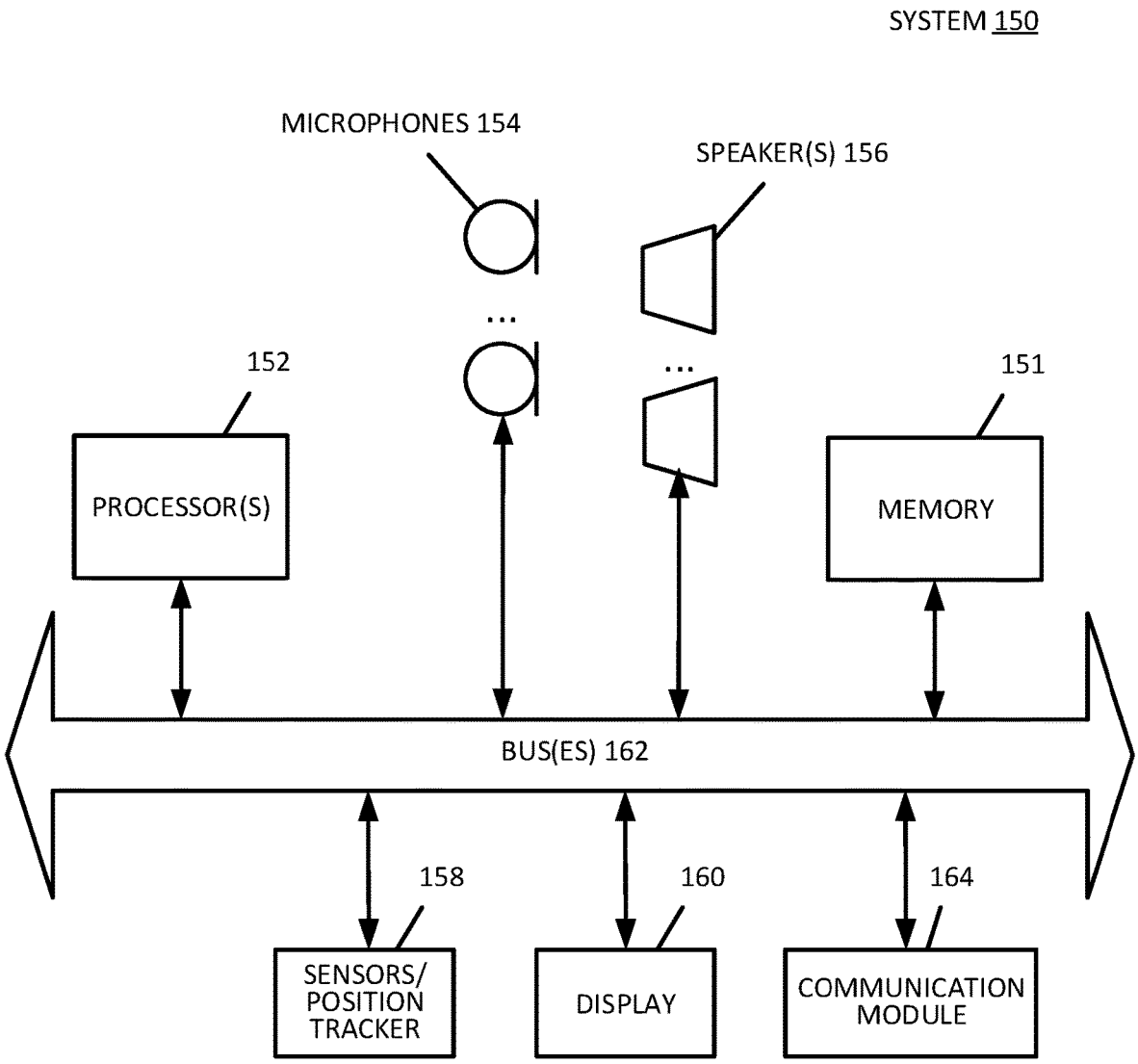
FIG. 5 shows an example audio system, according to some aspects.

FIG. 5 shows an example implementation of an audio system that can perform one or more of the algorithms and methods described in other sections using one or more programmed processors 152. Note that although this example shows various components of an audio processing system that may be incorporated into headphones, speaker systems, microphone arrays and entertainment systems, it is merely one example of a particular implementation and is merely to illustrate the types of components that may be present in the audio processing system. This example is not intended to represent any particular architecture or manner of interconnecting the components as such details are not germane to the aspects herein. It will also be appreciated that other types of audio processing systems that have fewer components than shown or more components than shown in this example audio system can also be used. For example, some operations of the process may be performed by electronic circuitry that is within a headset housing while others are performed by electronic circuitry that is within another device that is communication with the headset housing, e.g., a smartphone, an in-vehicle infotainment system, or a remote server. Accordingly, the processes described herein are not limited to use with the hardware and software shown in this example.

The components shown may be integrated within a housing, such as that of a smart phone, a smart speaker, a tablet computer, a head mounted display, head-worn speakers, or other electronic device described in the present disclosure. These include one or more microphones 154 which may have a fixed geometrical relationship to each other (and are therefore treated as a microphone array.) The audio system 150 can include speakers 156, e.g., ear-worn speakers or loudspeakers.

The microphone signals may be provided to the processor 152 and to a memory 151 (for example, solid state non-volatile memory) for storage, in digital, discrete time format, by an audio codec. The processor 152 may also communicate with external devices via a communication module 164, for example, to communicate over the internet. The processor 152 is can be a single processor or a plurality of processors.

The memory 151 has stored therein instructions that when executed by the processor 152 perform the processes described herein the present disclosure. Note that some of these circuit components, and their associated digital signal processes, may be alternatively implemented by hardwired logic circuits (for example, dedicated digital filter blocks, hardwired state machines.) In some aspects, the system includes a display 160 (e.g., a head mounted display).

In some aspects, the system can include one or more sensors or position trackers 158 that can include, for example, one or more cameras, inertial measurement units (IMUS), gyroscope, accelerometers, and combinations thereof. The system can apply one or more tracking algorithms to the sensed data to track a position of a user. The user position can be used in the approaches described herein (e.g., as the listener position used in ray tracing) to determine reverberation of sounds.

Various aspects descried herein may be embodied, at least in part, in software. That is, the techniques may be carried out in an audio processing system in response to its processor executing a sequence of instructions contained in a storage medium, such as a non-transitory machine-readable storage medium (for example DRAM or flash memory). In various aspects, hardwired circuitry may be used in combination with software instructions to implement the techniques described herein. Thus the techniques are not limited to any specific combination of hardware circuitry and software, or to any particular source for the instructions executed by the audio processing system.

In the description, certain terminology is used to describe features of various aspects. For example, in certain situations, the terms "renderer", "processor", "tracer", "reverberator", "component," "block," "renderer," "model", "extractor", "selector", and "logic" are representative of hardware and/or software configured to perform one or more functions. For instance, examples of "hardware" include, but are not limited or restricted to an integrated circuit such as a processor (for example, a digital signal processor, microprocessor, application specific integrated circuit, a microcontroller, etc.). Of course, the hardware may be alternatively implemented as a finite state machine or even combinatorial logic. An example of "software" includes executable code in the form of an application, an applet, a routine or even a series of instructions. As mentioned above, the software may be stored in any type of machine-readable medium.

It will be appreciated that the aspects disclosed herein can utilize memory that is remote from the system, such as a network storage device which is coupled to the audio processing system through a network interface such as a modem or Ethernet interface. The buses 162 can be connected to each other through various bridges, controllers and/or adapters as is well known in the art. In one aspect, one or more network device(s) can be coupled to the bus 162. The network device(s) can be wired network devices (e.g., Ethernet) or wireless network devices (e.g., WI-FI, Bluetooth). In some aspects, various aspects described (e.g., extraction of voice and ambience from microphone signals described as being performed at the capture device, or audio and visual processing described as being performed at the playback device) can be performed by a networked server in communication with the capture device and/or the playback device.

Some portions of the preceding detailed descriptions have been presented in terms of algorithms and symbolic representations of operations on data bits within a computer memory. These algorithmic descriptions and representations are the ways used by those skilled in the audio processing arts to most effectively convey the substance of their work to others skilled in the art. An algorithm is here, and generally, conceived to be a self-consistent sequence of operations leading to a desired result. The operations are those requiring physical manipulations of physical quantities. It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as those set forth in the claims below, refer to the action and processes of an audio processing system, or similar electronic device, that manipulates and transforms data represented as physical (electronic) quantities within the system's registers and memories into other data similarly represented as physical quantities within the system memories or registers or other such information storage, transmission or display devices.

The processes and blocks described herein are not limited to the specific examples described and are not limited to the specific orders used as examples herein. Rather, any of the processing blocks may be re-ordered, combined or removed, performed in parallel or in serial, as necessary, to achieve the results set forth above. The processing blocks associated with implementing the audio processing system may be performed by one or more programmable processors executing one or more computer programs stored on a non-transitory computer readable storage medium to perform the functions of the system. All or part of the audio processing system may be implemented as, special purpose logic circuitry (e.g., an FPGA (field-programmable gate array) and/or an ASIC (application-specific integrated circuit)). All or part of the audio system may be implemented using electronic hardware circuitry that include electronic devices such as, for example, at least one of a processor, a memory, a programmable logic device or a logic gate. Further, processes can be implemented in any combination hardware devices and software components.

While certain aspects have been described and shown in the accompanying drawings, it is to be understood that such aspects are merely illustrative of and not restrictive on the broad invention, and the invention is not limited to the specific constructions and arrangements shown and described, since various other modifications may occur to those of ordinary skill in the art. The description is thus to be regarded as illustrative instead of limiting.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. A method for generating reverberation, comprising:

performing ray tracing with one or more sound sources and a listener position, to generate one or more impulse responses associated with each of the one or more sound sources;

combining the one or more impulse responses to form a combined impulse response;

determining one or more filters, each corresponding to one of the one or more sound sources, based on the combined impulse response and the one or more impulse responses; and applying the combined impulse response and the one or more filters to one or more audio signals to produce audio having individualized reverberation of each of the one or more sound sources.

2. The method of claim 1, wherein combining the one or more impulse responses includes summing or averaging the one or more impulse responses.

3. The method of claim 1, wherein each of the one or more filters are determined based on difference between the combined impulse response and a corresponding one of the one or more impulse responses.

4. The method of claim 1, wherein performing the ray tracing includes originating rays from the listener position.

5. The method of claim 1, wherein performing the ray tracing includes receiving rays at each position of the one or more sound sources.

6. The method of claim 1, wherein performing ray tracing comprises counting ray energy in response to a received ray intersecting a sound source.

7. The method of claim 1, wherein as a number of the one or more sound sources increases, a number of rays are decreased in performance of the ray tracing.

8. The method of claim 1, wherein each of the one or more filters includes a frequency dependent correction factor.

9. The method of claim 1, wherein each of the one or more filters is associated with a delay.

10. The method of claim 1, wherein the combined impulse response and the one or more filters are transmitted to an electronic device for audio rendering.

11. The method of claim 1, wherein the combined impulse response and the one or more filters are received by an electronic device through a dedicated communication channel, and the one or more filters and the combined impulse response are applied to the one or more audio signals resulting in reverberated audio.

12. An audio processing system comprising a processor configured to perform operations including:

performing ray tracing with a plurality of sound sources and a listener position, to generate a plurality of impulse responses associated with each of the plurality of sound sources;

combining the plurality of impulse responses to form a combined impulse response; and determining one or more filters, each corresponding to one of the plurality of sound sources, based on the combined impulse response and the plurality of impulse responses, and applying the combined impulse response and the one or more filters to one or more audio signals to produce audio having individualized reverberation of each of the one or more sound sources.

13. The audio processing system of claim 12, wherein combining the plurality of impulse responses includes summing or averaging the one or more impulse responses.

14. The audio processing system of claim 12, wherein each of the plurality of filters are determined based on difference between the combined impulse response and a corresponding one of the plurality of impulse responses.

15. The audio processing system of claim 12, wherein performing the ray tracing includes originating rays from the listener position.

16. The audio processing system of claim 12, wherein performing the ray tracing includes receiving rays at each position of the plurality of sound sources.

17. An electronic device comprising a processor configured to perform operations including:

performing ray tracing with one or more sound sources and a listener position, to generate one or more impulse responses associated with each of the one or more sound sources;

combining the one or more impulse responses to form a combined impulse response;

determining one or more filters, each corresponding to one of the one or more sound sources, based on the combined impulse response and the one or more impulse responses; and applying combined impulse response and the one or more filters to one or more audio signals results to produce audio having individualized reverberation of each of the one or more sound sources.

18. The electronic device of claim 17, wherein combining the one or more impulse responses includes summing or averaging the one or more impulse responses.

19. The electronic device of claim 17, wherein each of the one or more filters are determined based on difference between the combined impulse response and a corresponding one of the one or more impulse responses.

20. The electronic device of claim 17, wherein performing the ray tracing includes originating rays from the listener position.

* * * * *